US005103232A

United States Patent [19]

Chang et al.

[11] Patent Number: 5,103,232

[45] Date of Patent: Apr. 7, 1992

[54] PHASE QUANTIZATION ERROR DECORRELATOR FOR PHASED ARRAY ANTENNA

[75] Inventors: Kaichiang Chang, Northborough; Garret E. Murdza, Boxborough; Fernando Beltran, Framingham; Robert D. Foltz, Wayland, all of Mass.

[73] Assignee: Raytheon Company, Lexington, Mass.

[21] Appl. No.: 687,267

[22] Filed: Apr. 18, 1991

[51] Int. Cl.[5] ..... H01Q 3/22

[52] U.S. Cl. ..... 342/372; 342/377

[58] Field of Search ..... 342/157, 371, 372, 377

[56] References Cited

U.S. PATENT DOCUMENTS

| | | | |
|---|---|---|---|
| 3,999,182 | 12/1976 | Moeller et al. | 342/372 |
| 4,191,960 | 3/1980 | Lopez | 342/372 |
| 4,445,119 | 4/1984 | Works | 342/377 |
| 4,445,119 | 4/1984 | Works | 343/377 |

OTHER PUBLICATIONS

"Minimizing the Effects of Phase Quantization Error in an Electronically Scanned Array", C. J. Miller, Proc. of Symposium on Electronically Scanned Array Techniques and Applications, RADC-TDR-64-225, vol. 1, Jul. 1964, pp. 17-38.

"Cobra Dane Wideband Pulse Compression System", E. Filer and J. Hartt, Paper No. 61, 1976 IEEE EASCON, Washington, D.C., Sep. 1976, pp. 26-29.

"Spatial Statistics of Instrument-Limited Angular Measurement Errors in Phased Array Radars", R. H. Sahmel and Roger Manasse, IEEE Transactions on Antennas and Propagation, vol. AP-21, No. 4, Jul. 1973, pp. 524-532.

*Primary Examiner*—Gregory C. Issing

*Attorney, Agent, or Firm*—Walter F. Dawson; Richard M. Sharkansky

[57] ABSTRACT

An improved means of decorrelating phase quantization errors in a phased array radar antenna using digital randomization at each of the array elements to reduce peak steering erorrs and to reduce peak sidelobe levels of the antenna. A random phase adjust term is provided to each of the array's antenna elements which comprises a distributed controller (DC) co-located with a digital phase shifter. The distributed controllers are each programmed with a random phase adjust term which represents a phase shift adjustment statistically independent from element to element. The random phase adjust term is stored in a memory located in each disbtributed controller. The distributed controller drives each element's digitally controlled phase shifter in response to a beam steering command received over a serial line. The performance improvement achieved with this decorrelation method is equivalent to that obtained by using more expensive phase shifters and adding costly randomized cables in the path to each element.

7 Claims, 5 Drawing Sheets

PHASE QUANTIZATION ERROR DECORRELATOR FOR PHASED ARRAY ANTENNA

The Government has rights to this invention pursuant to Contract No. DASG60-87-C-0014, awarded by the Department of the Army.

BACKGROUND OF THE INVENTION

This invention relates to an electronically scanned phased array radar and more particularly to an apparatus and method for improving angular measurement of an antenna beam by decorrelating peak phase quantization errors of digital phase shifters in the antenna using digital randomization.

A phased array antenna comprises a plurality of radiating elements typically arranged in planar and doubly periodic grid. Such an antenna in a radar system is well adapted to electronic scanning techniques which permit a pencil beam of electromagnetic energy to be moved rapidly from one direction to another by means of a plurality of phase shifter elements.

The phased array antenna can be corporate-fed or optically-fed from one or more radio-frequency (RF) sources. Uncollimated and unsteered power from such one or more RF sources equally distributed to individual elements passes through the phase shifter device and is radiated therefrom with a phase relationship determined by the setting of the individual phase shifter so as to provide the desired collimated and steered radiated wavefront. By the reciprocity theorem the device is reciprocal, i.e., energy reflected from distant objects and impinging on the array in the form of plane wavefront will be focused by the array in a direction corresponding to the setting of the individual phase shifter.

In U.S. Pat. No. 4,445,119, entitled "Distributed Beam Steering Computers," issued Apr. 24, 1984, to George A. Works, and assigned to the present assignee, a microcomputer is co-located with each phase shifter of a phased array antenna for calculating a phase shift steering command for each element of the phased array antenna. Such a distributed microcomputer or controller approach significantly reduces wiring, cables and differential drive cards and improves reliability.

Furthermore, in the prior art, it is well known that a digital phase shifter produces a phase quantization error which increases the pointing error of the antenna beam and antenna pattern sidelobe levels. For example, in an article entitled "Minimizing the Effects of Phase Quantization Error in an Electronically Scanned Array", by C. J. Miller, Proc. of Symposium on Electronically Scanned Array Techniques and Applications, RADC-TDR-64-225, Vol. 1, Jul. 1964, pp. 17–38, Miller suggests introducing variable lengths in the lines of a corporate-fed phased array antenna in order to minimize the peak phase quantization errors. To accomplish this phase error reduction, a piece of cable or waveguide segment has been inserted in series with each phase shifter in order to decorrelate this phase quantization error. Such an approach is referred to as "cable randomization" and it has been used in phased array radar systems such as the Cobra Dane (AN/FPS-108) Radar System used by the U.S. Air Force. (See "Cobra Dane Wideband Pulse Compression System," by E. Filer and J. Hartt, Paper No. 61, 1976 IEEE EASCON, Washington, D.C., Sept. 1976, pages 26–29). In this phased array radar system, 6-bit cable randomization was implemented with a 4-bit phase shifter for peak pointing error reduction of the antenna beam at reasonable cost.

However, more recent applications of phased array radars require higher angular measurement for antenna beam steering accuracies, which require phase quantization errors of digital phase shifters to be reduced significantly. For an angle accuracy specification of 50 microradians, an 8-bit cable randomization would be required in certain applications, but 6-bit cable randomization is a practical limit.

SUMMARY OF THE INVENTION

Accordingly, it is therefore an object of this invention to provide a distributed controller at each element of a phased array antenna to reduce phase shift error by performing digital randomization.

It is a further object of this invention to decorrelate peak phase quantization errors of digital phase shifters using digital randomization in order to improve angular measurement of the antenna beam and to reduce sidelobe levels of the antenna.

The objects are further accomplished by providing a phased array radar system comprising a source of electromagnetic energy, a plurality of antenna array elements for providing a directed beam of the electromagnetic energy, each of the array elements comprises a distributed controller, a phase shifter coupled to the distributed controller and an antenna element coupled to the phase shifter, means for feeding the electromagnetic energy to the plurality of antenna array elements through the plurality of phase shifters, means for coupling phase shift data to each distributed controller in the array elements, such data being used to compute a phase shift command word for each of the antenna elements in accordance with the position of each antenna element in the array, and the distributed controller comprises means for decorrelating the peak phase quantization error. The decorrelating means comprises means for computing the phase shift command word using digital randomization data. The distributed controller comprises means for storing constant data, variable data and random phase adjust data for each of the array elements, arithmetic means for multiplying the variable data by the constant data to obtain product terms of the phase shift command word for each of the array elements, and means for adding the product terms to the random phase adjust data in accordance with a predetermined beam steering angle equation for each of the array elements to accomplish digital randomization of the peak phase quantization error. The distributed controller further comprises an output controller for generating transmit and receive signals, providing external control data, storing a phase shift command word output and providing built-in test (BITE) operations.

The objects are further accomplished by a phased array antenna comprising a plurality of array elements, each of the array elements comprising a distributed controller, a phase shifter coupled to the distributed controller, and an antenna element coupled to the phase shifter, input means coupled to the distributed controller for providing control data, variable data, random phase adjust data and modes of operation data, the distributed controller comprises means for decorrelating peak phase quantization error in accordance with a predetermined phase shift command word equation calculation using the random phase adjust data, the distributed controller means further comprises arithmetic means for computing the phase shift command word, means coupled to the input means for controlling the arithmetic means and the transfer of the input data into the distributed controller, and means coupled to the controlling means and the arithmetic means for storing the input data provided by the input means. The arithmetic means comprises means for multiplying the variable data by the constant data to obtain product terms of the phase shift command word for each of the array elements, and means for adding the product terms to the random phase adjust data in accordance with the phase shift command word equation for each of said array elements to accomplish digital randomization of the peak phase quantization error. The distributed controller comprises an output controller for generating transmit and receive command signals, providing external control data, storing a phase shift command word output and providing BITE operations.

The objects are further accomplished by providing a method of reducing peak phase quantization errors in a phased array radar system comprising the steps of providing a source for electromagnetic energy, directing a beam of the electromagnetic energy with a plurality of antenna array elements in the antenna system, each of the array elements comprising a distributed controller, a phase shifter coupled to the distributed controller and an antenna element coupled to the phase shifter, feeding the electromagnetic energy to the plurality of antenna array elements through the plurality of phase shifters, and coupling phase shift data to each distributed controller in the array elements for computing a phase shift command word for each of the antenna elements in accordance with the position of each antenna element in the array, and decorrelating peak phase quantization error by means in the distributed controller. The step of providing means for decorrelating peak phase quantization error comprises using digital randomization data. The step of computing a phase shift command word comprises the steps of storing constant data, variable data and random phase adjust data for each of the array elements, multiplying the variable data by the constant data to obtain product terms of the phase shift command word for each of the array elements, and adding the product terms to the random phase adjust data in accordance with a predetermined beam steering angle equation for each of the array elements to accomplish digital randomization of the peak phase quantization error.

BRIEF DESCRIPTION OF THE DRAWINGS

Other and further features and advantages of the invention will become apparent in connection with the accompanying drawings wherein.

DESCRIPTION OF THE PREFERRED EMBODIMENT

Figure 1:
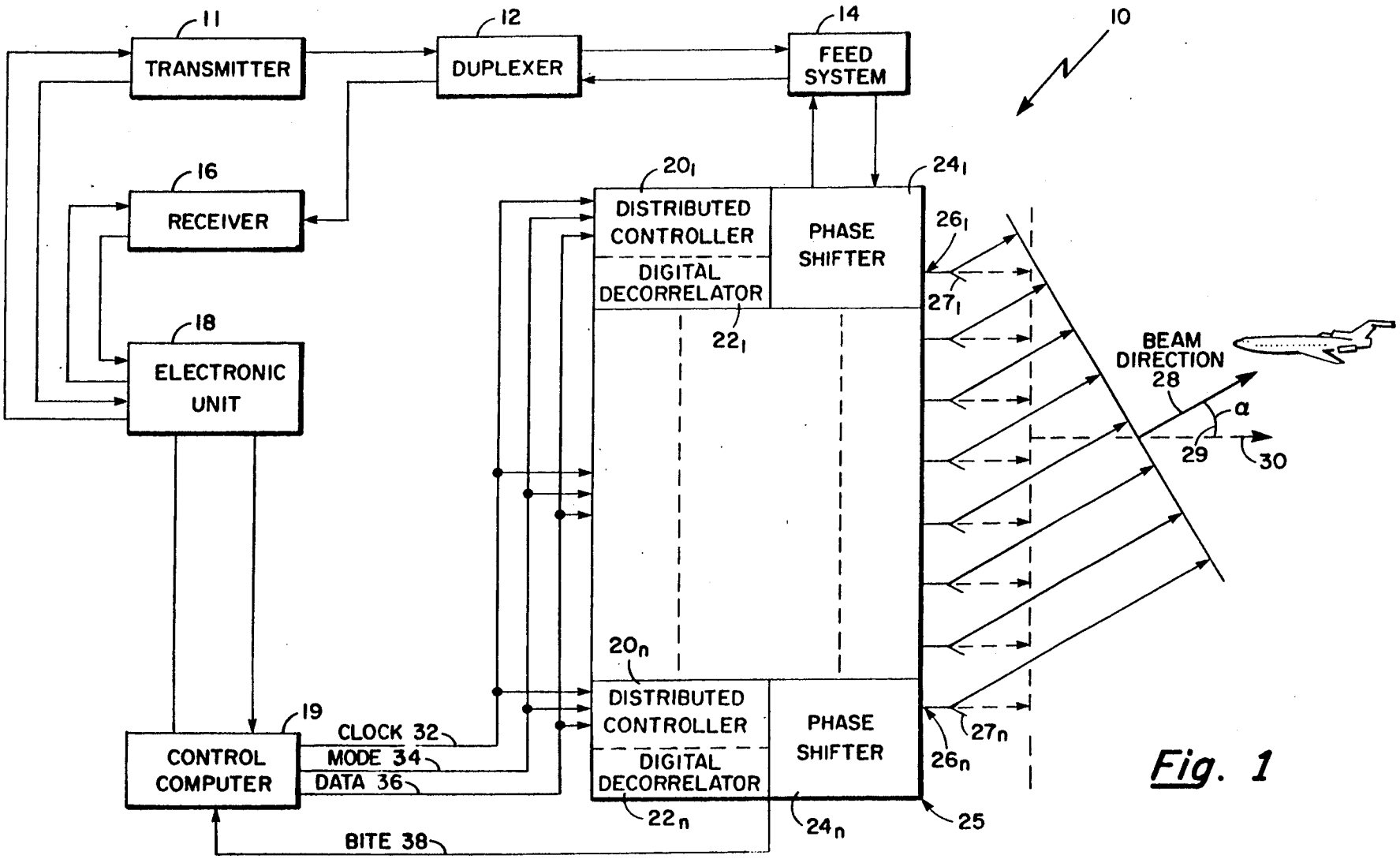
FIG. 1 is a simplified block diagram of a phased array radar system embodying the invention of digital decorrelator in a beam steering distributed controller which provides digital randomization at each phase shifter element of a phased array antenna.

Referring to FIG. 1, there is shown a phased array radar system 10 having a phased array antenna 25 comprising a plurality of antenna elements $\mathbf{26}_{l\text{-}n}$, each element having a radiating aperture $\mathbf{27}_{l\text{-}n}$ fed by a phase shifter $\mathbf{24}_{l\text{-}n}$ and a beam steering distributed controller $\mathbf{20}_{l\text{-}n}$ coupled to said phase shifter $\mathbf{24}_{l\text{-}n}$ comprising a digital decorrelator invention employing digital randomization for reducing peak phase quantization error. The distributed controller $\mathbf{20}_{l\text{-}n}$ comprises a very large scale integrated (VLSI) circuit chip employing CMOS technology for calculating the phase shift for each particular element of the phase array antenna 25 based primarily on the phased array antenna 25 geometry and the element $\mathbf{26}_{l\text{-}n}$ location. Electromagnetic energy is distributed by a feed system 14 through the phase shifters $\mathbf{24}_{l\text{-}n}$ for determining the direction of the energy beam 28 emitted from the phased array antenna 25. The beam steering command is accomplished by calculating the amount of phase shift to be applied to the radiant energy of the phase shifter from the feed system 14 and such phase shift calculation, depending on application requirements, may include a temperature correction (TC) factor for temperature effects at each antenna element location as described in U.S. patent application Ser. No. 608,047, filed Oct. 31, 1990 by John C. Murray et al., and assigned to the present assignee.

A source of electromagnetic energy is provided by a transmitter 11, and a duplexer 12 controls the energy being transmitted and received by the array antenna 25. A radar return signal is sent to a receiver 16 and an electronic unit 18 provides timing and control signals for the complete phased array radar system 10. A control computer 19 performs the data processing of the radar data and performs built-in test (BITE) or self-test capability for aiding in diagnostics and fault isolation of the distributed controllers $\mathbf{20}_{l\text{-}n}$. The control computer 19 provides initialization data comprising algorithm constants to each of the distributed controllers $\mathbf{20}_{l\text{-}n}$. Three serial control lines, clock 32, mode 34 and data 36 are coupled from the control computer 19 to the distributed controllers $\mathbf{20}_{l\text{-}n}$ and one serial BITE line is coupled from the distributed controllers $\mathbf{20}_{l\text{-}n}$ to the control computer 19. The three serial control lines enable the distributed controllers $\mathbf{20}_{l\text{-}n}$ to be communicated with individually or all controllers $\mathbf{20}_{l\text{-}n}$ simultaneously.

Each distributed controller $\mathbf{20}_{l\text{-}n}$ in the present embodiment performs a phase shifter command ($\Phi_{MN}$) calculation using the following phase shift algorithm in order to determine a global beam steering angle command:

$$\Phi_{MN}=\mathrm{MDCX}_{MN}{*}\mathrm{S}+\mathrm{MDCY}_{MN}{*}\mathrm{T}+\mathrm{DP}_{MN}{*}\mathrm{TR}+\mathrm{M}\Delta\Phi_{COL}+\mathrm{N}\Delta\Phi_{ROW}+\gamma$$

where:

(a) M,N are the array column and row geometry indices (16 bits each).

(b) $\Delta\Phi_{COL}$ and $\Delta\Phi_{ROW}$ are the incremental column and row phase shift commands (16 bits each).

(c) $\mathrm{CP}_{MN}{*}\mathrm{TR}$ is the addition of 0 degrees (TRA) or 180° (REC) for half of the elements, where DP is 180° and TR is zero or one for transmit and receive duplexing.

(d) $\gamma$ is a random phase adjustment term generated using digital randomization.

(e) $MDCX_{MN}$ and $MDCY_{MN}$ are the array deflection compensation terms, as a function of M and N.

(f) S and T are two array deflection variables that are extracted from a look-up table when the array is tilted at a specific angle in the elevation plane.

In the above equation, $\Phi_{MN}$ is the amount of phase shift per array element required to achieve a certain overall beam direction 28 as illustrated in FIG. 1. However, one skilled in the art readily knows that certain terms of such equation other than the column and row phase shift terms and the random phase adjustment term may vary depending on the architecture of the specific phased array antenna design. The computed result of the phase shift command word comprises an integer part plus a fractional part. Only the fractional part, or least significant bits, are needed to control the phase shifter in a phase steered antenna. In a time-delay steered antenna, the complete phase shift command word would be used.

Figure 2:
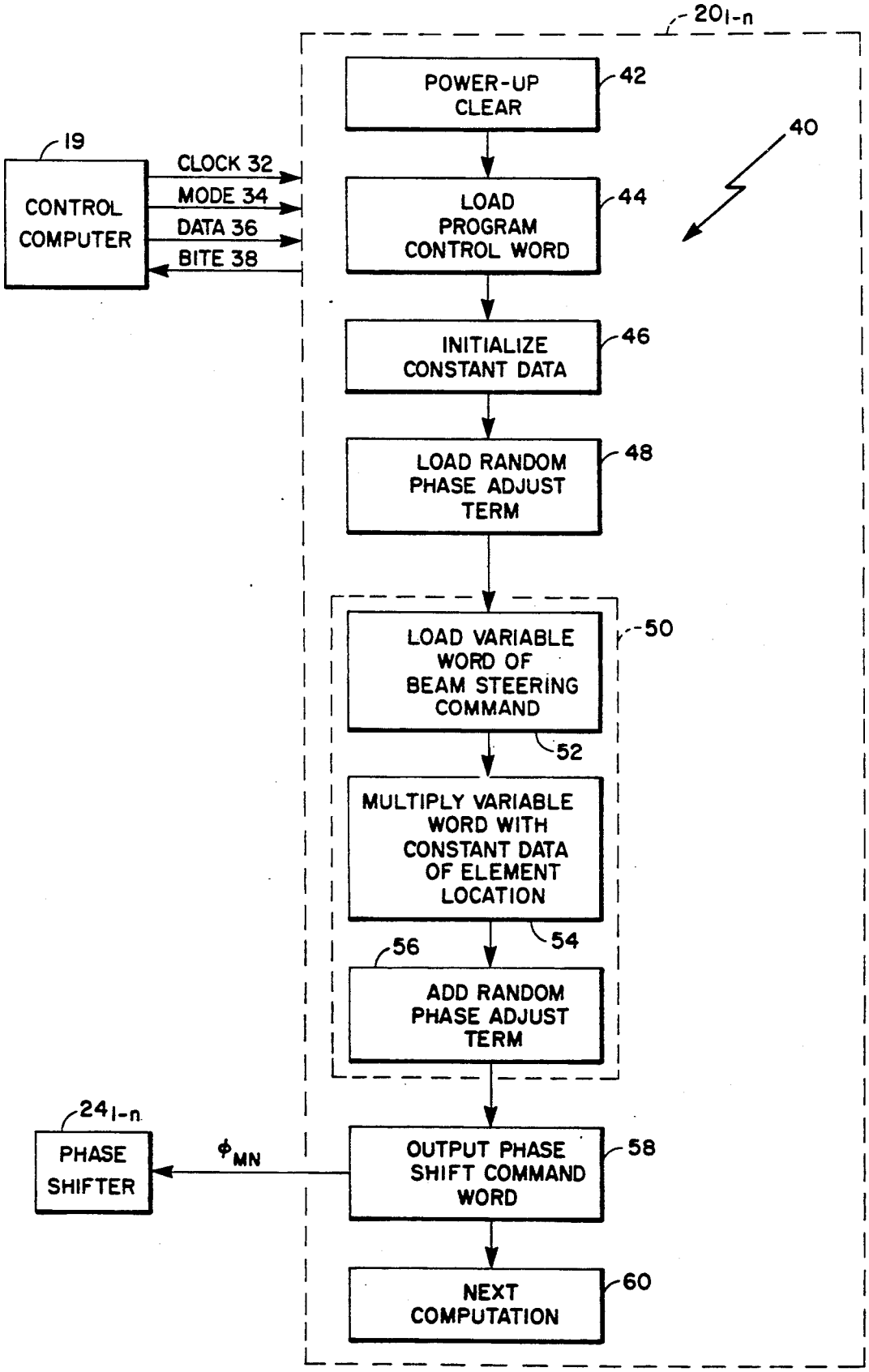
FIG. 2 is a flow chart of the present invention of digital randomization for reducing peak phase quantization error.

The M and N index constants provide coordinate information for each element in an array antenna in order to form the beam 28 coherently in a specific direction. Typically, the $\Delta\Phi_{COL}$ variable equals $(\sin \alpha)/\lambda$ and $\Delta\Phi_{RPW}$ equals $(\sin \beta)/\lambda$ where alpha ($\alpha$) represents the elevation steering angle and beta ($\beta$) represents the azimuth steering angle; lambda ($\lambda$) represents the wavelength of the radial frequency emitted on antenna beam. Other variables may be defined depending on the type of phased array antenna and application requirements known to one skilled in the art. Sin $\alpha$, sin $\beta$, etc. and $1/\lambda$ phase shift parameters are simultaneously sent to all array elements for determining a specific amount of phase shift to form the antenna beam 28 in a desired direction. Therefore, the constants are stored in each distributed controller and the phase shift parameters are received via serial data 36 lines as shown in FIG. 2. When the reciprocal of $\lambda$ is sent to the distributed controller, a multiplication is performed instead of a division when calculating the phase shift command, $\Phi_{MN}$. Any number and combination of constants may be used in this phase shift algorithm depending on system requirements. After the calculations have been completed, the distributed controller $\mathbf{20}_{l\text{-}n}$ can format the phase shift value into various types of outputs, including digital outputs of up to 8 bits for diode phase shifter applications and pulsed outputs for systems using ferrite phase shifters.

Figure 3:
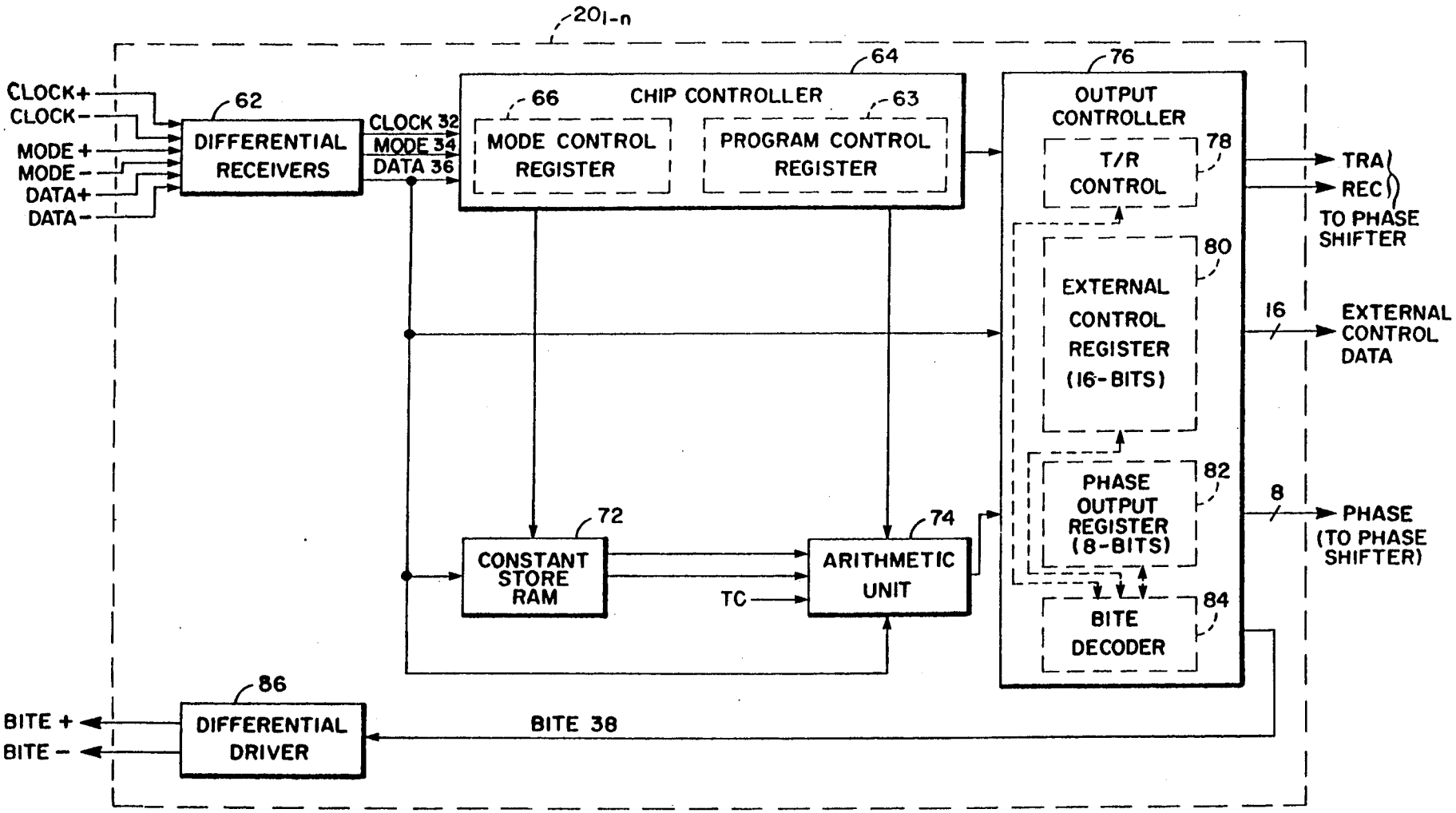
FIG. 3 is a block diagram of the distributed controller embodying a digital decorrelator for reducing peak phase quantization error.

Referring now to FIG. 2 and FIG. 3, FIG. 2 is a flow chart of the present invention of a digital decorrelator routine 40 employing digital randomization. FIG. 3 is a block diagram of the distributed controller $\mathbf{20}_{l\text{-}n}$ embodying the digital correlator routine 40. The digital decorrelator routine 40 operates on data received from the control computer 19 which is stored in a RAM 72 of the distributed controller $\mathbf{20}_{l\text{-}n}$. The decorrelator routine 40 is also located in RAM 72, and the purpose of this routine is to reduce peak phase quantization error, which if not reduced results in large pointing error of the antenna beam direction 28 ($\alpha$). When power-up 42 occurs, a clear signal is generated which clears all the registers and RAM 72 in the distributed controller $\mathbf{20}_{l\text{-}n}$. Next a load program control word 44 (as defined in Table 4) operation is performed wherein the program control word is loaded into the distributed controller $\mathbf{20}_{l\text{-}n}$ and stored in the RAM 72. Then initialize constant data 46 operation occurs which loads constant data of the array geometry and element location from the control computer 19 into the RAM 72. Next, a load random phase adjust term 48 occurs which provides a unique random number having an upper bound of a least significant bit of the phase shifter for each phase shift element location of the array; such phase adjust terms are stored in RAM 72. As a result of this random number being added into the phase command, a stochastic resonance is produced in the phased array, that is, a cooperative effect of the stochastic perturbation (random phase adjust data) and periodic forcing, which is the product term of the phase command, leads to an amplification of the peak of the power spectrum requiring only small amounts of phase command, due to a mechanism such as a phased array antenna. With stochastic resonance any small amount of force (phase command) can steer the beam away from its "old" position. A compute phase shift command word 50 operation is then performed which performs the operation of load variable word of beam steering command 52, multiply variable word with constant data of element location 54 and add random phase adjust term 56. The computed phase shift command word ($\Phi_{MN}$) is then forwarded to the phase shifter $\mathbf{24}_{l\text{-}n}$, and next phase shift command word is computed for another element location.

To understand the operation of the present invention, the pointing error of a 10-foot X-band phased array is evaluated. Such an array contains 21,504 elements each containing a 6-bit digital ferrite phase shifter $\mathbf{24}_{l\text{-}n}$ with a 16-bit distributed controller $\mathbf{20}_{l\text{-}n}$. The formats of constants (C2–C7) and variables ($\phi$1–$\phi$6) for the phase shift algorithm is shown in Table 1 and their value ranges are shown in Tables 2 and 3. Note that for M and N, the LSB is 2°. The random phase adjust term ($\gamma$) is generated by a random number generator and its value is ranged from $2^{-6}$ to $2^{-16}$ for maximizing decorrelation capability and minimizing artificially injected error. The first column in Table 1 further shows the sequence of the calculations performed to solve the equation for $\Phi_{MN}$ as defined above. The 16-bit distributed controller $\mathbf{20}_{l\text{-}n}$ operates such that the result of multiplying the LSB's of the constants and variables equals the LSB of the result. Thus, for the six bits of the phase shifter to be at the correct outputs, the LSB of the result must be $2^{-16}$ as shown in Table 1.

TABLE 1

| $\Phi_{MN}$ TERMS | BITS | FORMAT +/MSB | | | | LSB | C/V |
|---|---|---|---|---|---|---|---|
| $MDCX_{MN}$ * | 10 | S | $2^{-1}$ | $2^{-2}$ | $2^{-3}$ | $2^{-9}$ | C7 |
| S + | 16 | $2^{8}$ | $2^{7}$ | $2^{6}$ | $2^{5}$ | $2^{-7}$ | $\Phi$1 |
| $MSCY_{MN}$ * | 10 | S | $2^{-1}$ | $2^{-2}$ | $2^{-3}$ | $2^{-9}$ | C6 |
| T + | 16 | $2^{8}$ | $2^{7}$ | $2^{6}$ | $2^{5}$ | $2^{-7}$ | $\Phi$2 |
| $DP_{MN}$ * | 10 | S | $2^{7}$ | $2^{6}$ | $2^{5}$ | $2^{-1}$ | C5 |
| TR + | 16 | $2^{0}$ | $2^{-1}$ | $2^{-2}$ | $2^{-3}$ | $2^{-15}$ | $\Phi$3 |
| M * | 16 | S | $2^{14}$ | $2^{13}$ | $2^{12}$ | $2^{0}$ | C4 |
| $\Delta\Phi_{COL}$ + | 16 | $2^{-1}$ | $2^{-2}$ | $2^{-3}$ | $2^{-4}$ | $2^{-16}$ | $\Phi$4 |
| N * | 16 | S | $2^{14}$ | $2^{13}$ | $2^{12}$ | $2^{0}$ | C3 |
| $\Delta\Phi_{ROW}$ + | 16 | $2^{-1}$ | $2^{-2}$ | $2^{-3}$ | $2^{-4}$ | $2^{-16}$ | $\Phi$5 |
| $\gamma$ | 16 | S | $2^{-2}$ | $2^{-3}$ | $2^{-4}$ | $2^{-16}$ | C2 |

TABLE 1-continued

| $\Phi_{MN}$ TERMS | BITS | FORMAT +/MSB | | | | LSB | C/V |
|---|---|---|---|---|---|---|---|
| • | | | | | | | |
| 1 | 16 | $2^{15}$ | $2^{14}$ | $2^{13}$ | $2^{12}$ | $2^{0}$ | $\Phi 6$ |
| = | | | | MSB | | LSB | |
| $\Phi_{MN}$ | 16 | $2^{-1}$ | $2^{-2}$ | $2^{-3}$ | $2^{-4}$ | $2^{-16}$ | |
| | | (BITS $2^{-1}$ to $2^{-6}$ used for $\Phi_{MN}$ Command) | | | | | |

TABLE 2

| CONSTANT | MAX VALUE | LSB | NOTES |
|---|---|---|---|
| $MDCX_{MN}$ | $\pm 2^{-2}$ | $\pm 2^{-9}$ | 0.3 Inch Maximum Deflection |
| $MDCY_{MN}$ | $\pm 2^{-2}$ | $\pm 2^{-9}$ | 0.3 Inch Maximum Deflection |
| $DP_{MN}$ | $2^{-1}$ | $2^{-1}$ | DUPLEXING (Transmit or Receive) |
| M | $\pm 2^{6.46}$ | $\pm 2^{0}$ | +88 to −87 dx = .69992" Element Spacing in Column |
| N | $\pm 2^{7.29}$ | $\pm 2^{0}$ | +157 to −156 dy = .4041" Element Spacing in Row |
| $\gamma$ | $2^{-6}$-$2^{-16}$ | $-2^{-16}$ | ROUNDING ($2^{-7}$) & RANDOM PHASE ADJUST |

TABLE 3

| VARIABLE | MAX VALUE | LSB | NOTES |
|---|---|---|---|
| S,T | $2^{0}$ | $2^{-7}$ | Deflection Look-Up (Elevation Angle) |
| TR | $2^{0}$ | $2^{-15}$ | Duplexing |
| $\Delta\Phi_{COL}$ | $2^{0}$-$2^{-16}$ | $2^{-16}$ | |
| $\Delta\Phi_{ROW}$ | $2^{0}$-$2^{-16}$ | $2^{-16}$ | |
| 1 | $2^{0}$ | $2^{-1}$ | To Align $\gamma$ |

Figure 4:
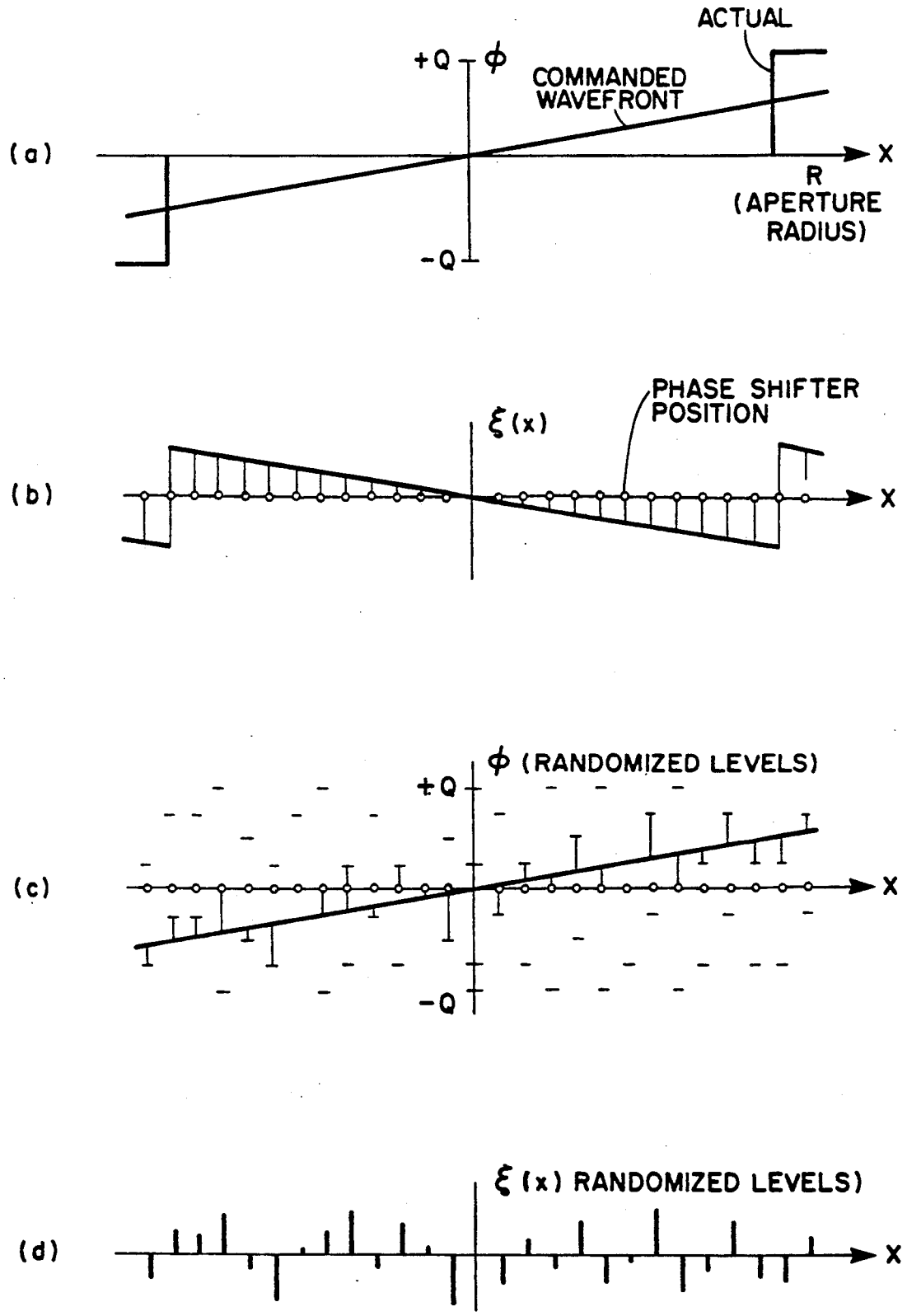
FIGS. 4(*a*)–4(*d*) show the effect of randomization techniques on decorrelating peak phase errors due to quantization of the phase shifter in a corporate-fed phased array antenna.

Referring now to FIG. 4, the improvement in angular measurement resulting from decorrelation of the peak quantization error using either cable or digital randomization is illustrated schematically for a worst-case situation. This illustration using cable randomization was provided in an article by Rainer H. Sahmel and Roger Manasse, "Spatial Statistics of Instrument—Limited Angular Measurement Errors in Phased Array Radars," IEEE Transactions on Antennas and Propagation, Vol. AP-21, No. 4, Jul. 1973, pp. 524–532. A one dimensional case has been considered where the desired phase is a linear function of the aperture coordinate X. As illustrated in FIG. 4(*a*), the beam steering of the array normal is small, and the commanded phase causes only the phase shifters at the very edge of the aperture to switch out of the zero state. In FIG. 4(*b*), the difference between the commanded and actual phase function is a linear phase error term which will cause an angular error approximately equal to the commanded steering angle. FIG. 4(*c*) illustrates the effect of randomized quantization levels. The horizontal dashes indicate the location of the nearest quantization levels for each phase shifter. In all cases, the commanded phase is quantized to the nearest available quantization level. The resulting phase errors at each phase shifter shown in FIG. 4(*d*) are seen to have a random character which will not give rise to a large angular error.

Figure 5:
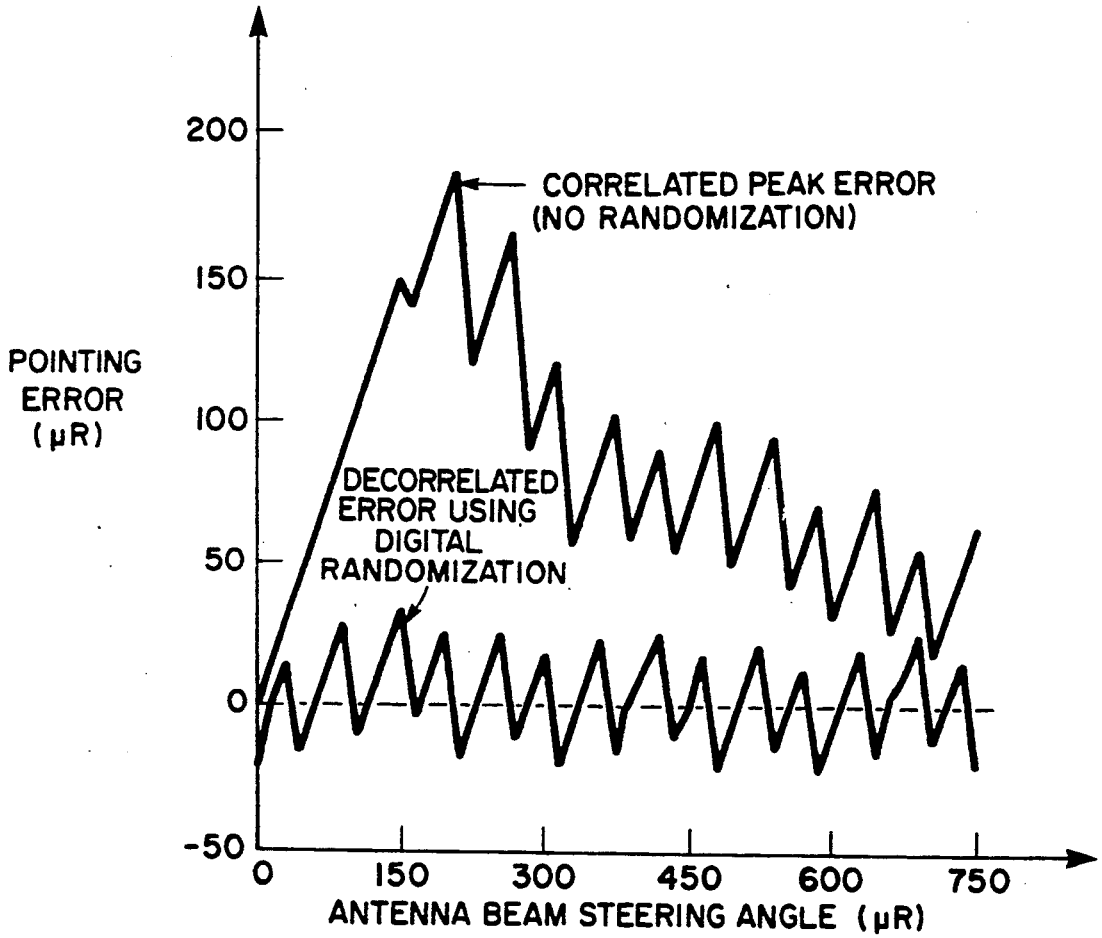
FIG. 5 is a graph showing a correlated peak pointing error of the steered beam and reduced pointing error of the steered beam decorrelated by using digital randomization.

Referring now to FIG. 5, a graph of pointing error ($\mu$R) of the antenna vs. array scan ($\mu$R) shows the correlated (peak) error in the phased array antenna without randomization and the resulting significantly reduced decorrelated error when the digital randomization of the present invention is employed.

Referring again to FIG. 3, the beam steering distributed controller $\mathbf{20}_{l\text{-}n}$ shown is implemented with VLSI CMOS gate-array technology on a 0.300"×0.300" die. Differential receivers 62 receive the differential forms of the three serial control signals clock 32, mode 34 and data 36 and provide these signals to a chip controller 64. The chip controller 64 converts the serial mode 34 and data 36 signals into parallel control words for use by other portions of the distributed controller $\mathbf{20}_{l\text{-}n}$. A program control register 68 within the chip controller 64 stores a 20-bit program control word which determines the terms and variable word length used for a phase shift algorithm and defines the current BITE mode. Table 4 lists the individual bit functions of the program control word. A mode control register 66 stores the mode word received from the control computer 19 and the mode word is decoded and used both in a direct form and in a pulsed form to provide required mode control. The functions of the decoded mode word are listed in Table 5. The functions of the BITE mode bits of the program control word are listed in Table 6.

The random access memory (RAM) 72 receives data from the serial data 36 input under the control of the chip controller 64. The RAM 72 stores the constants for each element location, beam steering command data and a random phase-adjust term of the phase-shift algorithm until needed by an arithmetic unit 74.

The arithmetic unit 74 comprises a 17-bit serial multiplier and serial adder (not shown but known to one skilled in the art) which forms partial product terms and subsequently a full product term. The product term size is that of a BAMS (Binary Angular Measurement System) variable. The full product term is added to any other accumulated terms such as $\gamma$ of the phase-shift algorithm using the 17-bit serial adder within the arithmetic unit 74. Any negative constant term is taken care of by including a 2's compliment adjustment at the input to the serial adder. The final accumulated result is truncated to eight most significant fractional bits (MSBs) for parallel output to an output controller 76.

TABLE 4

| Program Control Word Bit | Function | Description | |
|---|---|---|---|
| 1 | Start Bit | | |
| 2 | B0 | Built-In Test Mode | |
| 3 | B1 | | |
| 4 | B2 | | |
| 5 | Spare | | |
| 6 | Phase Adj. | Selects Phase ADJ Term | |
| 7 | Spare | | |
| 8 | T/R | Transmit/Receive | |
| 9 | Out Mode | Activates Pulse Mode for Ferrite Shifters | |
| 10 | Spare | | |
| 11 | VLO | Selects Variable Word Length | |
| 12 | VLI | | |
| 13 | VL2 | | |
| 14 | C7 | $MDCX_{MN}$ | Phase Shift Algorithm Constant Enables |
| 15 | C6 | $MDCY_{MN}$ | |
| 16 | C5 | $TR_{MN}$ | |
| 17 | C4 | M | |
| 18 | C3 | N | |
| 19 | C2 | $\gamma$ | |
| 20 | C1 | Not Used | |

TABLE 5

| Mode Word M3 | M2 | M1 | M0 | Mode Function |
|---|---|---|---|---|
| 0 | 0 | 0 | 1 | Initialization |

TABLE 5-continued

| Mode Word | | | | |
|---|---|---|---|---|
| M3 | M2 | M1 | M0 | Mode Function |
| 0 | 0 | 1 | 0 | Compute |
| 0 | 0 | 1 | 1 | Output Trigger |
| 0 | 1 | 0 | 0 | Master Clear |
| 0 | 1 | 0 | 1 | Data Clear |
| 0 | 1 | 1 | 0 | BITE Trigger |
| 1 | 0 | 0 | 0 | Receive Trigger |
| 1 | 0 | 0 | 1 | Reset Trigger |
| 1 | 0 | 1 | 1 | Load External Control Register |
| 1 | 1 | 0 | 1 | Load Program Control Word |
| 1 | 1 | 0 | 1 | Load BITE |
| 1 | 1 | 1 | 0 | BITE Enable |
| 1 | 1 | 1 | 1 | BITE Reset |

TABLE 6

| BITE Mode Code (B2 to B0) | BITE MODE FUNCTION |
|---|---|
| 000 | Data Rebound |
| 001 | External Control |
| 010 | Parallel Output |
| 100 | Pulse Output |
| 101 | T/R Control |
| 111 | Bit Wiggle |

If it is desired in a specific application to compensate for temperature variations at each element of the array antenna $27_{l-n}$, a temperature correction (TC) factor for the phase shift algorithm may be generated from an ambient temperature measurement made by a thermal sensor and fed into the distributed controller $20_{l-n}$ as described in U.S. patent application Ser. No. 608,047 referenced hereinbefore. The temperature correction (TC) factor would be fed to the serial adder input of the arithmetic unit 54 which may be added into the sum of products in the beam steering calculation producing a phase output which has been corrected for temperature at the antenna element location.

Still referring to FIG. 3, the eight MSBs of the phase-shift calculated in the arithmetic unit 74 are transferred to an output controller 76 where they are loaded into an 8-bit phase output register 82. In a bit wiggle mode of operation a phase value can be loaded directly from the input data 36 line and then transferred to the phase output register 82. The output controller 76 comprises a 16-bit external control register which is loaded directly from the data 36 input and it is used to store external control words to control, for example, attenuators. Transmit (TRA) and receive (REC) control signals are derived from a decoded T/R mode signal fed to a T/R control 78 in the output controller 76. The TRA and REC control signals are used to switch monolithic microwave integrated circuit (MMIC) devices and subsequently control the transmit/receive duty cycles.

The output controller 76 also comprises a built-in test (BITE) decoder 84. A BITE code ($B_2B_1B_0$) of the program control word (Table 4) is decoded and used to select one of four BITE return modes listed in Table 6 comprising data rebound BITE, external control BITE, parallel output BITE (PARBITE) and T/R control BITE. In a data rebound mode, data sent by the chip controller 64 is automatically returned on the BITE 38 line to confirm correct reception by the distributed controller $20_{l-n}$. The external control BITE mode allows any data stored in the 16-bit external control register (ECR) 80 to be transferred serially to the BITE 38 line. In the parallel output BITE (PARBITE) mode any phase value stored in the phase output register 82 can be clocked-out serially onto the BITE 38 line by first transferring the 8-bit value to the eight least significant bit (LSB) positions of the external control register 80. The T/R control BITE mode verifies that the distributed controller $20_{l-n}$ has been placed in the transmit mode or receive mode. The logic-OR of the transmit (TRA) or receive (REC) control signals is placed on the BITE 38 line for verification. The BITE 38 line is connected to a differential driver 86 for transferring BITE data to the control computer 19. The control computer 19 sets up each distributed controller $20_{l-n}$ into the BITE mode and tests the data sent back over the BITE 38 line. The distributed controller $22_{l-n}$ may be embodied by a CMOS VLSI chip, Part No. 295A089, manufactured by Raytheon Company of Lexington, Mass., the present assignee.

This concludes the description of the preferred embodiment. However, many modifications and alterations will be obvious to one of ordinary skill in the art without departing from the spirit and scope of the inventive concept. Therefore, it is intended that the scope of this invention be limited only by the appended claims.

What is claimed is:

1. A phased array radar system comprising:

a source of electromagnetic energy;

a plurality of antenna array elements for providing a directed beam of said electromagnetic energy;

each of said array elements comprises a distributed controller, a phase shifter coupled to said distributed controller and an antenna element coupled to said phase shifter;

means for feeding said electromagnetic energy to said plurality of antenna array elements through the plurality of phase shifters;

means for coupling phase shift data to each distributed controller in said array elements, such data being used to compute a phase shift command word for each of said antenna elements in accordance with the position of each antenna element in said array;

said distributed controller comprises means for storing said phase shift data including constant data, variable data and random phase adjust data for each of said array elements;

arithmetic means for multiplying said variable data by said constant data to obtain product terms of said phase shift command word for each of said array elements; and means for adding said product terms to said random phase adjust data having an upper bound of a least significant bit of said phase shifter in accordance with a predetermined beam steering angle equation for each of said array elements to produce stochastic resonance in said antenna array elements which decorrelates peak phase quantization error.

2. The phase array radar system as recited in claim 1 wherein:

said distributed controller comprises an output controller for generating transmit and receive signals, providing external control data, storing a phase shift command word output and providing BITE operations.

3. A phased array antenna comprising:

a plurality of array elements, each of said array elements comprising a distributed controller, a phase shifter coupled to said distributed controller, and an antenna element coupled to said phase shifter;

input means coupled to said distributed controller for providing constant data, variable data, random phase adjust data and modes of operation data;

said distributed controller further comprises arithmetic means for computing said phase shift command word using digital randomization, said arithmetic means comprising means for multiplying said variable data by said constant data to obtain product terms of said phase shift command word for each of said array elements;

means for adding said product terms to said random phase adjust data having an upper bound of a least significant bit of said phase shifter in accordance with said phase shifter equation for each of said array elements to produce stochastic resonance in said phased array antenna which decorrelates peak phase quantization error;

means coupled to said input means for controlling said arithmetic means and the transfer of said input data into said distributed controller; and means coupled to said controlling means and said arithmetic means for storing said input data provided by said input means.

4. The phased array radar system as recited in claim 3 wherein:

said distributed controller comprises an output controller for generating transmit and receive signals, providing external control data, storing a phase shift command word output and providing BITE operations.

5. A method of reducing peak phase quantization errors in a phased array radar system comprising the steps of:

providing a source for electromagnetic energy;

directing a beam of said electromagnetic energy with a plurality of antenna array elements in said radar system, each of said array elements comprising a distributed controller, a phase shifter coupled to said distributed controller and an antenna element coupled to said phase shifter;

feeding said electromagnetic energy to said plurality of antenna array elements through said plurality of phase shifters;

coupling phase shift data to each distributed controller in said array elements for computing a phase shift command word for each of said antenna elements in accordance with the position of each antenna element in said array;

storing said phase shift data including constant data, variable data and random phase adjust data for each of said array elements;

multiplying said variable data by said constant data to obtain product terms of said phase shifter for each of said array elements; and adding said product terms to said random phase adjust data having an upper bound of a least significant bit of said phase shifter in accordance with a predetermined beam steering angle equation for each of said array elements to product stochastic resonance in said antenna array elements which decorrelates peak phase quantization error.

6. The method as recited in claim 5 wherein:

said method further comprises the step of performing self-test at each of said array elements with said distributed controller.

7. A method of reducing peak phase quantization errors in a phased array antenna comprising the steps of:

directing a beam of electromagnetic energy with a plurality of array elements, each of said array elements comprising a distributed controller, a phase shifter coupled to said distributed controller, and an antenna element coupled to said phase shifter;

providing with an input means constant data, variable data, random phase adjust data and modes of operation data to said distributed controller;

decorrelating peak phase quantization error with said distributed controller in accordance with a predetermined phase shift command word equation calculation using said random phase adjust data;

multiplying said variable data by said constant data to obtain product terms of said phase shift command word for each of said array elements;

adding said product terms to said random phase adjust data having an upper bound of a least significant bit of said phase shifter in accordance with said phase shift command word equation for each of said array elements to produce stochastic resonance in said phased array antenna which decorrelates peak phase quantization error;

controlling said arithmetic means and the transfer of said input data into said distributed controller; and storing said input data provided by said input means with memory means coupled to said arithmetic means.

* * * * *